United States Patent [19]

Davey

[11] 4,397,155

[45] Aug. 9, 1983

[54] STIRLING CYCLE MACHINES

[75] Inventor: Gordon Davey, Oxford, England

[73] Assignee: National Research Development Corporation, London, England

[21] Appl. No.: 276,983

[22] Filed: Jun. 24, 1981

[30] Foreign Application Priority Data

Jun. 25, 1980 [GB] United Kingdom ..... 8020735

[51] Int. Cl.[3] ..... F25B 9/00

[52] U.S. Cl. ..... 62/6; 60/520; 62/228

[58] Field of Search ..... 62/6, 228; 60/520

[56] References Cited

U.S. PATENT DOCUMENTS 3,774,405 11/1973 Leo ..... 62/6

4,118,943 10/1978 Chellis ..... 62/6

4,306,419 12/1981 Schwartz ..... 62/6

*Primary Examiner*—Ronald C. Capossela

*Attorney, Agent, or Firm*—Oblon, Fisher, Spivak, McClelland & Maier

[57] ABSTRACT

A Stirling cycle machine in which the compressor/expander is in driving connection with a first electromagnetic unit, and in which a second electromagnetic unit is connected to the displacer and can be operated as an externally-variable control of the movements of the displacer. In one form of the invention the second unit acts as an electromagnetic damper upon movements which the displacer makes in natural response to those of the compressor. In another form of the invention the second unit positively drives the displacer and the two units are interconnected by means including a phase-shifting device whereby movements of compressor and displacer are kept of equal frequency but variable as to phase difference. Transducers sensitive to position, velocity or accelaration may improve control of the movements of compressor and displacer, and a temperature sensor associated with the "cold finger" of the displacer may further improve control of the movements of the latter.

10 Claims, 4 Drawing Figures

1
2
3
4
5
6
8
9
10
11
12
13
14
14a
15
16
17
18
19
20
21
26
27
28
29
30
31
32
33

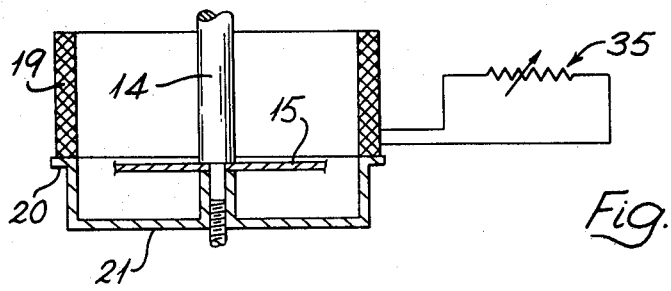
Fig. 2
Fig. 3
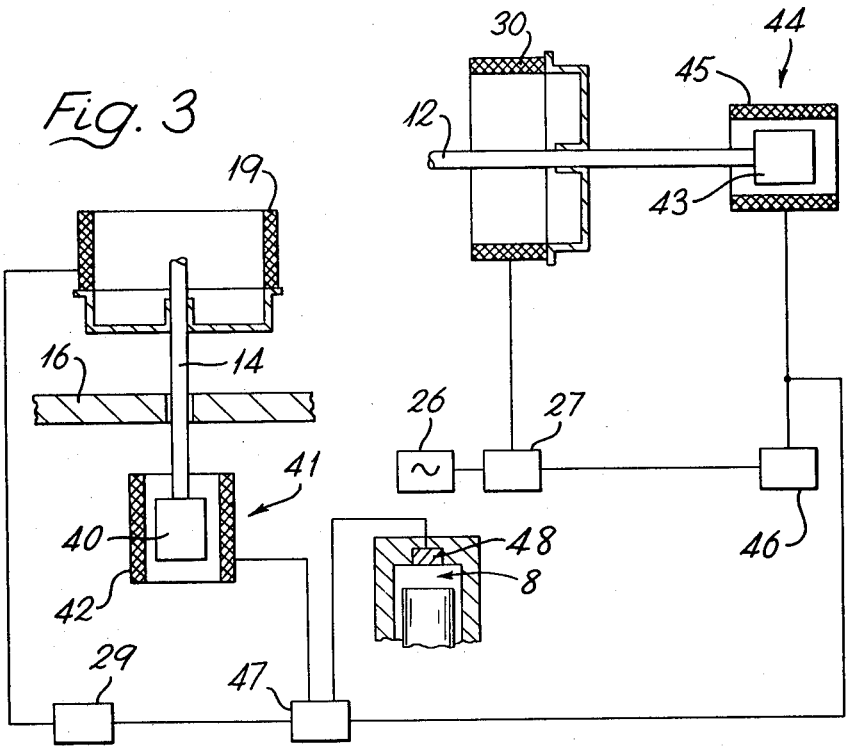
Fig. 4
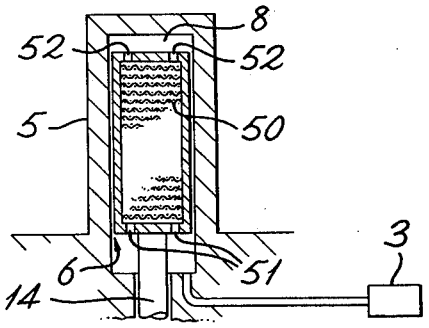

STIRLING CYCLE MACHINES

This invention relates to machines using the Stirling thermodynamic cycle. Such machines, as is well known, contain at least one of each of two essential moving parts, the movements of which are similar but must be out-of-phase with each other within certain limits. One of these parts is usually known as the displacer, and often comprises a plunger movable with clearance within a cylinder whereby to transfer a mass of gas in alternate directions between the two ends of the cylinder. It is a characteristic of the cycle that one end of the displacer becomes or is maintained cold relative to the other, hence the use of Stirling machines (working as heat pumps) in refrigerators. The relatively hot end of the displacer is connected by way of a heat exchanger to the other essential moving part of the machine, which typically comprises a piston movable within a cylinder and will be referred to as the compressor. This moving part constitutes the interface between the machine and mechanical work: when the machine is acting as a heat pump the piston of this part is externally driven. If however the machine is to work in the reverse sense, that is to say as an engine, then external power is used to maintain the appropriate temperature difference between the two ends of the displacer. The resulting pulsations of pressure within the machine drive the piston of the compressor so that it can perform external mechanical work.

It is known for the compressor/expander to be connected to an electromagnetic device, for instance of coil-and-magnet type, which may generate electrical energy when the machine is acting as an engine and which may receive such energy to act as the external compressor drive when the machine is acting as a heat pump. Some forms of Stirling heat pump are known in which the displacer acts as a "free piston" and in which, by designing to achieve the right natural frequencies of oscillation, the displacer responds to the compressor output with movements that show the right difference in phase from those of the compressor itself. More often, however, the displacer and compressor are both driven and the drives are connected by mechanisms whereby the phase difference can be controlled. These mechanisms can be complicated. Regulation of the amplitudes of movement of the displacer and compressor is also difficult.

The present invention arises from appreciating that by connecting an electromagnetic motion-controlling device to the displacer and jointly controlling both this device and the electromagnetic device already associated with the compressor, the problems of adjusting and controlling the phase difference and amplitudes of the two moving parts of the machine may be greatly simplified.

The invention is a Stirling cycle machine comprising a displacer and a compressor, in which the compressor is connected to an electromagnetic device which acts as the compressor power source in one mode of operation of the machine and as a driven source of electrical energy in the other, and in which the relationship between the movements of the displacer and the compressor is controlled by a second electromagnetic device.

The second electromagnetic device may operate so as to control the stroke of the displacer. It may also comprise a coil carried by the displacer plunger and movable within the field of a stationary magnet. The coil may be in series connection with a resistor which may be variable, whereby to vary its influence upon the motion of the displacer plunger.

In the cases just described the second electromagnetic device thus provides variable damping of motions which the displacer plunger is caused to execute by some other source of motive power, for instance in free response to the driven compressor. Alternatively the second electromagnetic device may positively drive the displacer, the coils being connected to a source of electrical power. Preferably this is the same source of electrical power that drives or is driven by the compressor, and a suitable phase-shifting device is interposed between the power source and one of the electromagnetic devices to ensure that the motions executed by the displacer and the compressor/expander are of equal frequency but are out-of-phase to the degree that is necessary for the Stirling cycle under which the machine is working.

Further electromagnetic components may include transducers sensitive to position, velocity or acceleration and associated with the moving parts of either the displacer or the compressor, or with both of them, the output of such transducers being used to improve the control of movement and relative movement of these parts. When the machine is working as a heat pump, for instance, the output of the transducer associated with the compressor may typically be used to control the drive so that the compressor piston always moves at the fullest possible amplitude of stroke while avoiding hitting the ends of its cylinder. Such improved control has special benefits during conditions when ambient temperature and/or thermal load of the machine are changing, or if the machine as a whole is movable and is being subjected to acceleration or changes of attitude. Similarly, the transducer associated with the displacer may be used to control the amplitude of movement of the displacer plunger, and also its phase with respect to that of the compressor/expander as a means of controlling the output of the machine. While it is relatively simple to achieve accurate phase difference between the displacer and the compressor without continuous monitoring of the plunger position if the motion of both of these parts is sinusoidal, with such monitoring it is more feasible to achieve more complex, non-sinusoidal motion. For example, if the piston of the compressor executes sinusoidal motion, for optimum Stirling cycle performance the motion of the displacer plunger should sometimes be at the same frequency, out of phase but not quite sinusoidal in character.

The invention is also defined by the claims, the contents of which should be deemed as forming part of the disclosure of this specification. The invention will now be described, by way of example, with reference to the accompanying drawings in which:

FIG. 2 is a diagrammatic sectioned view of part of a modified machine;

FIG. 3 is a schematic view of parts of yet another modification, and

FIG. 4 shows an alternative to part of the machine shown in FIG. 1.

Figure 1:
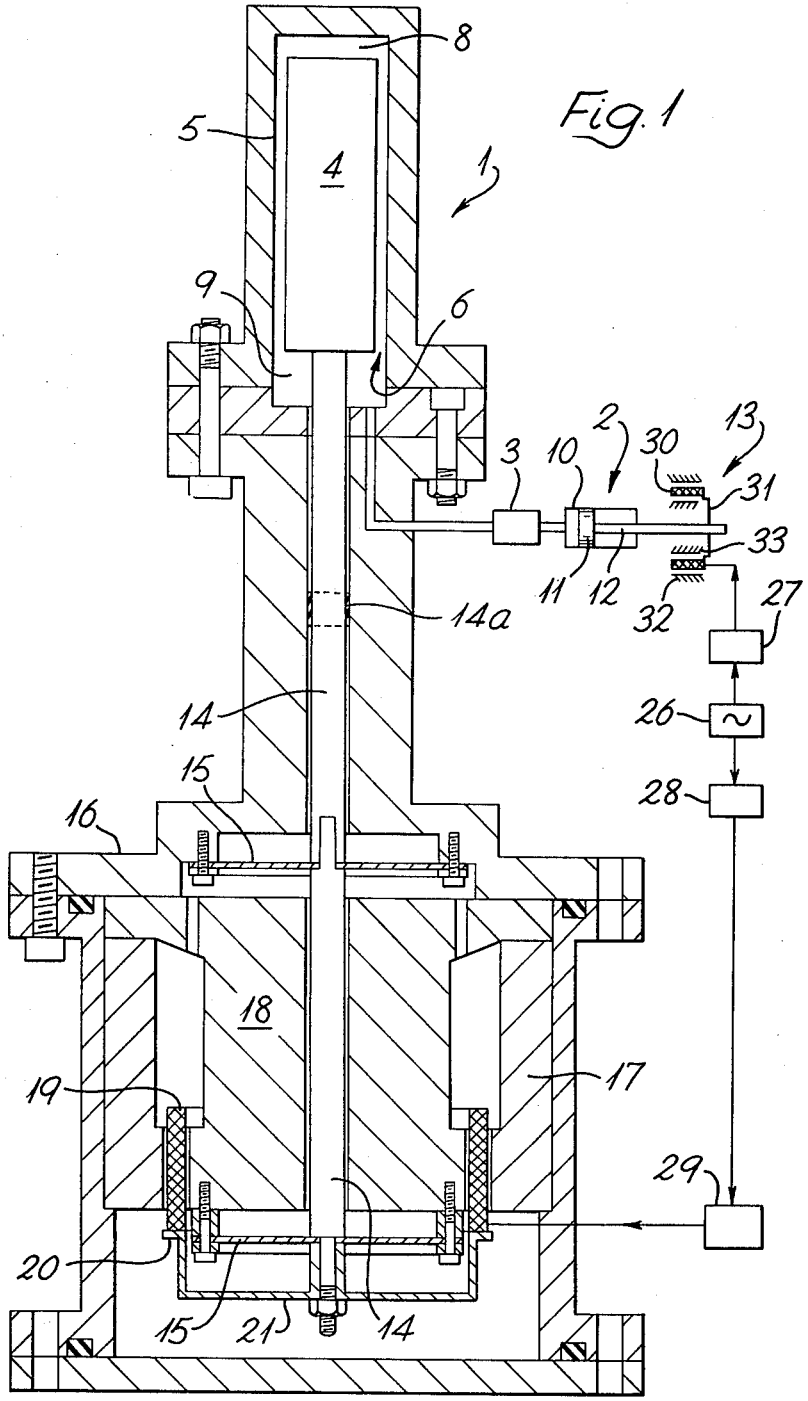
FIG. 1 is a view, partly in section and partly diagrammatic of a Stirling cycle machine.

FIG. 1 shows a Stirling machine comprising a displacer 1 and a compressor 2, communicating by way of a heat exchanger 3 and containing a gaseous working medium such as helium. The machine will be described as if it were working as a whole as a heat pump, with the unit 2 positively driven, but it should be understood that the machine is capable of working in the reverse sense and behaving as a motor, in which case power is extracted from unit 2.

As is customary in some Stirling cycle machines, the displacer 1 comprises a piston 4 movable within a cylinder 5 and separated from it by a small annular clearance 6. The walls of the clearance act as a regenerative heat exchanger, and movement of the piston to and fro within the cylinder causes gas to be displaced through clearance 6 in alternate directions between the blind or distal end 8 of the cylinder and the opposite end 9, and the operation of the cycle causes end 8 to become relatively cold and end 9 relatively warm. End 9 is adjacent heat exchanger 3. Compressor 2 comprises a cylinder 10 containing a piston 11 driven by way of a rod 12 by a first electromagnetic device 13 which serves as a motor in this mode of working of the machine and of course as a generator of electrical energy in the reverse mode.

Piston 4 is connected to one end of a rod 14, constrained to axial travel by two flat spiral springs 15 which connect rod 14 to the fixed structure of a housing 16. Housing 16 also encloses a second electromagnetic device including a fixed and a moving component. The fixed component comprises a permanent magnet 17 and core 18, mounted within housing 16. The movable component comprises a cylindrical coil 19, carried on the rim 20 of a platform 21 carried by rod 14. A gas-tight seal 14*a* isolates the displacer drive mechanism from the parts of the machine containing the gaseous working medium.

The efficient working of a Stirling cycle requires the pistons of the displacer and the compressor to oscillate at appropriate amplitudes and at the same frequency, but at least out of phase and possibly to a different pattern of motion. FIG. 1 illustrates one way, according to the invention, by which the motions of pistons 4 and 11 may be held to oscillating motions that are equal in frequency, similar (for instance generally sinusoidal) in pattern but variably displaced in phase. In FIG. 1 the second electromagnetic device acts as an electromagnetic motor and positively drives piston 4: a source 26 of alternating EMF is connected to coil 19 by way of a phase angle change device 28 and a power amplifier 29. In turn the first electromagnetic device 13 acts as a motor which drives the piston 11 of compressor 2, and which comprises a coil 30 supported on a platform 31 carried by rod 12 and movable within the field of a fixed magnet 32 and core 33. Coil 30 is connected to the same alternating EMF generator 26 by way of a power amplifier 27. In response to the output of generator 26 pistons 4 and 11 will reciprocate sinusoidally at the same frequency, and by adjustment of device 28 the relative phase of the two pistons may be varied.

Electronic phase-shifting devices suitable for use as item 28 are now readily available and relatively inexpensive, and enable the apparatus just described with reference to FIG. 1 to achieve the necessary amplitudes and phase relationship between the piston movements of the displacer and compressor more simply and compactly than in many machines of the prior art in which a single source of motive power was connected to the two pistons by mechanical linkages. However the present invention can also be applied with advantage to another known form of Stirling cycle machine in which only the compressor piston is positively driven, and in which the displacer is so designed that its free response to the compressor output is such that it oscillates at the same frequency but at the appropriate phase shift and amplitude. The "Beale"-type machine is one known Stirling engine that works in this way. It will readily be understood that to achieve and retain such a free response precisely requires firstly accurate design and manufacture and then careful maintenance. The present invention offers the prospect of achieving at least the right amplitude without the need for such accurate initial manufacture, and of simple adjustment to restore it should it change during use. In a machine according to this aspect of the present invention the compressor piston 11 may be driven, as in FIG. 1, by an electomagnetic motor 13 powered from generator 26 by way of power amplifier 27. However, the coil 19 of the second electromagnetic device is no longer connected to generator 26. Instead, as shown in FIG. 2, the coil is simply in series connection with a variable resistor 35. The series combination of coil and resistor now acts as a variable damper by which the motion, and in particular the amplitude of the response, of displacer piston 4 to the pulsating output that it receives from compressor 2 by way of heat exchanger 3 can be varied. The capacity to vary the amplitude of stroke of the displacer piston (and indeed of the compressor piston also) while the machine is working is valuable because the efficiency of the machine depends critically on optimising the amplitude of stroke of the compressor and the displacer, particularly the latter. Commonly, but not always, the optimum amplitude is simply the greatest that is possible without creating the danger of the piston striking the end walls of its cylinder. If the machine is adjusted so that these amplitudes are obtained when the machine starts to run, changes in the temperatures of the displacer or the compressor brought about either by the running of the machine or by variation in ambient conditions will then cause the piston strokes to change detrimentally unless their amplitude can be corrected in use.

In each of the examples of the invention shown in FIGS. 1 and 2 such correction can be achieved easily by operation of a control device external to the structure of the machine and involving no physical movement of components of that structure, whereas in typical known apparatus correction is either not possible or is achievable only by an adjustment of the gas circuitry within the sealed part of the machine. Features such as needle valves have to be introduced into the design of that circuitry to make such adjustments possible at all; it is often difficult to set such valves and their performance tends to change readily in response to changes in operating conditions.

In the embodiments of the invention shown in FIGS. 1 and 2 scope for varying the relative phase and especially the relative patterns of motion of pistons 11 and 4 is limited by the absence of any control based upon continuous monitoring of the instantaneous behaviour of the two pistons. Such control is provided in the embodiment shown in FIG. 3. Here piston rod 14 carries the movable member 40 of a device 41 which monitors the position of piston 4 but could alternatively monitor its velocity or acceleration. Device 41 also comprises a fixed coil 42, and rod 12 of piston 11 carries the movable member 43 of a similar monitoring device 44 also comprising a fixed coil 45. Two electronic position control units 46, 47 of function-generating capability are provided: the output of device 44 is fed to both of these, and the output of device 41 to unit 47 only. Power amplifier 27 receives inputs both from unit 46 and from power source 26, and the output of amplifier 27 drives the compressor motor 13 as before. The output of unit 47, like that of unit 28 in FIG. 1, is fed as before to the coil 19 of the displacer motor by way of amplifier 29. Using such control, it is now possible by appropriate setting of the two units 46 and 47 to achieve much greater control variation between the motions of the two pistons. Such versatility of control may be very valuable if the machine as a whole is subjected to varying external forces, caused for instance by temperature change or by acceleration if the machine is mobile; in the latter case acceleration monitoring may obviously be specially appropriate. In particular such control facilitates driving the displacer other than sinusoidally, which is valuable because as already indicated the true Stirling cycle requires the displacer to move out-of-phase and nearly but not quite sinusoidally in response to truly sinusoidal oscillation of the compressor.

The control circuitry illustrated in FIG. 3 offers the prospect of very accurate feedback control of the temperature of cold end 8 of displacer 1 when the machine is used as a heat pump. Such control could be achieved by the use of a temperature sensor 48, the output of which is fed as an extra input to unit 47 and serves to vary the amplitude of the displacer piston, limiting still further an amplitude that has already been limited to some degree by device 41 and unit 48.

FIG. 1 shows a displacer piston 4 of the kind known as a gap regenerator in which the gaseous working medium of the machine exchanges heat while passing through clearance 6. Alternatively, as shown in FIG. 4, piston 4 could be hollow and filled with regenerative material such as gauze discs 50 and formed with gas ports 51, 52 in its end walls. Heat exchange will now take place as the gas passes to and fro through the interior of the piston so that there must be an effective gas seal between piston 4 and cylinder 5 to prevent gas short-circuiting. Experience has shown that the accurate alignment given to rod 14 by flat spiral springs 15 enables the dimension of clearance 6 to be so small that an effective clearance seal can be set up without the need for any rubbing contact.

A further advantage of the present invention as a whole over the mechanical linkages used in the past to synchronise the displacer and compressor is that the electromagnetic controls do away with the need for moving components to pass through the walls of the machine. Totally-enclosed systems are therefore possible, so that the valuable working gas can be sealed within the machine.

I claim:

1. A Stirling cycle machine comprising:

a displacer, a compressor;

a first electromagnetic device connected to said compressor and acting as the compressor power source in one mode of operation of said machine and as a driven source of electrical energy in another, and a second electromagnetic device connected to said displacer and operable as an externally-variable control of the movements of said displacer.

2. A Stirling cycle machine according to claim 1 in which said second electromagnetic device operates to control the stroke of said displacer.

3. A Stirling cycle machine according to claim 2 in said second electromagnetic device comprises:

a magnetic part, and a coil part movable within said magnetic part, one of said parts being carried by said displacer and the other being stationary.

4. A Stirling cycle machine according to claim 3 in which said coil part is carried by said displacer.

5. A Stirling cycle machine according to claim 3 comprising an externally-variable resistor in series connection with said coil part, whereby to vary the influence of said second electromagnetic device upon the motion of said displacer.

6. A Stirling cycle machine according to claim 1 in which said second electromagnetic device also positively drives said displacer.

7. A Stirling cycle machine according to claim 6 comprising electrical means including a phase-shifting device, and in which said first and said second electromagnetic devices are interconnected by said electrical means to ensure that the motions executed by said displacer and said compressor are of equal frequency but out-of-phase to a variable degree.

8. A Stirling cycle machine according to claim 1 including at least one transducer responsive to functions belonging to the group comprising position, velocity or acceleration, said at least one transducer being associated with said compressor and said first electromagnetic device whereby to improve the control of the movements executed by said compressor.

9. A Stirling cycle machine according to claim 1 including at least one transducer responsive to functions belonging to the group comprising position, velocity or acceleration, said at least one transducer being associated with said displacer and said second electromagnetic device whereby to improve the control of the movements executed by said displacer.

10. A Stirling cycle machine according to claim 9 and adapted to work as a heat pump so as to create a source of cold at the distal end of said displacer, and including a temperature sensor located at said distal end of said displacer and associated with said second electromagnetic device whereby further to improve the control of the movements executed by said displacer.

* * * * *